United States Patent [19]

Reed et al.

[11] 3,973,899

[45] Aug. 10, 1976

[54] APPARATUS FOR USING EXHAUST STEAM FOR SMOKE SUPPRESSION IN FLARES

[75] Inventors: Robert D. Reed; John S. Zink, both of Tulsa, Okla.

[73] Assignee: John Zink Company, Tulsa, Okla.

[22] Filed: Feb. 3, 1975

[21] Appl. No.: 546,261

[52] U.S. Cl. ..... 431/202; 23/277 C; 431/5

[51] Int. Cl.[2] ..... F23D 13/20

[58] Field of Search ..... 431/202, 5, 4, 190; 23/277 C

[56] References Cited

UNITED STATES PATENTS

| | | | |
|---|---|---|---|
| 3,771,940 | 11/1973 | Stranaham et al. | 431/4 |
| 3,779,689 | 12/1973 | Reed et al. | 431/202 X |
| 3,887,324 | 6/1975 | Reed et al. | 431/5 |

*Primary Examiner*—Edward G. Favors
*Attorney, Agent, or Firm*—Head, Johnson & Chafin

[57] ABSTRACT

Apparatus for using exhaust low pressure steam for smoke suppression in flares by mixing the steam with the vented hydrocarbon gases prior to combustion, and prior to flow to the flare stack. The device comprises a cylindrical housing with means at a first end for the inflow of hydrocarbon vent gases, and outflow at the second end of hydrocarbon gases plus water vapor. Exhaust steam is entered through the side wall near the second end and the steam conduit is bent into an axial position, facing upstream of the steam flow. The end of the conduit is closed. There are a plurality of radial pipes of small diameter closed at their outer ends, extending into the steam conduit and between it and the cylindrical housing. A plurality of small diameter holes are drilled into the small pipes in a plane through the small pipes which is transverse to the axis of the housing. Steam flow issues from the small openings in one or more planes perpendicular to the axis of the housing, and at right angles to the flow of vent gases, so that the vent gases readily mix with and are heated by the steam and take up water vapor prior to combustion.

8 Claims, 7 Drawing Figures

APPARATUS FOR USING EXHAUST STEAM FOR SMOKE SUPPRESSION IN FLARES

BACKGROUND OF THE INVENTION

In all industrial facilities where steam is used as an energy source, it has become a typical practice to avoid exhausting of steam to the atmosphere and to collect all such exhaust steam in a closed system of piping, which is maintained at some pressure greater than atmospheric pressure.

The purpose of such a system is essentially for condensation of the exhausted steam as distilled water, which contains appreciable sensible heat for use as preheated boiler feed water. This avoids the depositing of scale within the boiler or steam generator. Also, this system of condensation avoids the presence of steam plumes in the atmosphere. The pressure within the collecting system is kept as low as possible in order to insure maximal use of the high pressure steam energy, and is typically in the range of 10 to 25 psi gauge, according to the initial steam pressure prior to exhaust. A typical ratio of high pressure and low pressure is in the order of 10 to 1.

Because of the operation as outlined, the value of exhaust steam per 1,000 pounds weight is not great, whereas steam at 100 psi gauge costs a minimum of $1.50 per 1,000 pounds, or substantially 10 times as much. Because of demand for conservation of heat energy there is a frantic search for greater use of exhaust steam values.

Because the state of the art of smoke suppression in flame burning of hydrocarbons requires steam at great hourly rates, there is a continued look to exhaust steam for possible use in flares for smoke suppression. However, because of the low pressure typical of exhaust steam, such low pressure steam is rarely used for smoke suppression in flares in the conventional manner.

This invention permits the use of low pressure exhaust steam for smoke suppression at the flare, for either complete suppression of smoke, or for a sharp reduction in demand for high pressure steam, according to the particular nature of the hydrocarbons being flared. It also provides for premixture of steam with hydrocarbons, prior to burning, in such manner as to insure the presence of vapor phase water, which is homogeneously mixed with vapor phase hydrocarbons, prior to burning, where a significant mol percentage of the mixture is as water vapor.

It is now common in the art of smoke suppression to inject steam into the hydrocarbons after burning of the hydrocarbons has started. Steam injected from high pressure, from orifices, is moving at critical or sonic velocity, and for that reason is a source of kinetic energy which is spent in air entrainment with the steam and in creation of turbulence, as the steam-air mixture enters the burning hydrocarbons. Injected air plus turbulence greatly enhances burning of the hydrocarbons, but a very significant result of steam injection to burning hydrocarbons is the typical reforming chemistry in the heated zone of burning hydrocarbons, according to the following equation:

$$CH_4 + H_2O = CO + 3H_2$$

It is to be noted that the reaction as shown, which alone is effective to a degree in suppression of smoke, is a vapor phase reaction which demands that water present in the combustion zone must be in vapor phase rather than as liquid, in order to accomplish greatest suppression of smoke. Smoke is suppressed because through the reaction as shown, carbon is combined with oxygen to form carbon monoxide, which is both invisible and rapid burning. On the other hand, smoke results because of the presence of free carbon as it escapes from the combustion zone.

If a small quantity of steam or water vapor is added to hydrocarbons at 60°F the water vapor promptly condenses and becomes liquid particles, since the ability of hydrocarbon gases to retain water in vapor phase is governed by the hydrocarbon temperature. For example, at 60°F the mol percentage of water vapor is approximately 1.75%, however, at 150°F approximately 26% of the volume of a gas-water vapor mixture is a water vapor. Since the gaseous phase reaction is governed by the partial pressure of the reactants, it is obvious that for a satisfactory state of smoke suppression, the partial pressure (mol percentage) of water vapor must be a significant portion of the total pressure, and temperature elevation is required to contain this large mol percentage of water vapor where the temperature of the steam-hydrocarbon mixture is elevated suitably through the heat content of the steam added to hydrocarbon, to cause the mol-percentage of water vapor in the water vapor-hydrocarbon mixture to be significant following thorough mixture of the two gases. Also, the gas-water vapor mixture must be homogeneous for optimum reaction and smoke suppression. Furthermore, and because the source pressure for venting hydrocarbons to atmospheric pressure may be severely limited, the steam injection must not add significantly to the pressure drop from the source to the atmosphere.

There are established conditions for optimum use of exhaust steam, or low pressure steam, injection to hydrocarbon gases for the purpose of smoke suppression as the gases are flare burned, and where there is premixture of steam with hydrocarbons, as the hydrocarbons are en route to the flare for burning. Note that prior effort for such use of steam has met with limited success, and such use of steam is largely abandoned because of failure to meet the conditions as outlined above.

SUMMARY OF THE INVENTION

It is a primary object of this invention to provide apparatus for injecting low pressure exhaust steam into the flow of vented hydrocarbons and admixture therewith, with heating, and with minimum pressure drop, prior to burning, for the purpose of smoke suppression.

This and other objects are realized and the limitations of the prior art are overcome in this invention by using a mixing chamber, or housing, which has sufficient cross-section so that with vent gas entry at one end, and steam flow through nozzles within the housing, there will be complete and thorough mixing of the steam with the vent gases, with a minimum of pressure drop, so as not to reduce the flow of vent gases and steam to the flare. The steam is supplied through an axial conduit inside of the housing and through a plurality of radial pipes, all of which are drilled along their length in a plane transverse to the housing, so that essentially a planar sheet of steam is presented perpendicular to the flow of the vent hydrocarbons, so as to promote complete mixing and heating of the vent gases and their combination with water vapor in a substantial mol percentage.

BRIEF DESCRIPTION OF THE DRAWINGS

This and other objects and advantages of this invention and a better understanding of the principles and details of the invention will be evident from the following description taken in conjunction with the appended drawings, in which.

DESCRIPTION OF THE PREFERRED EMBODIMENT

Figure 2:
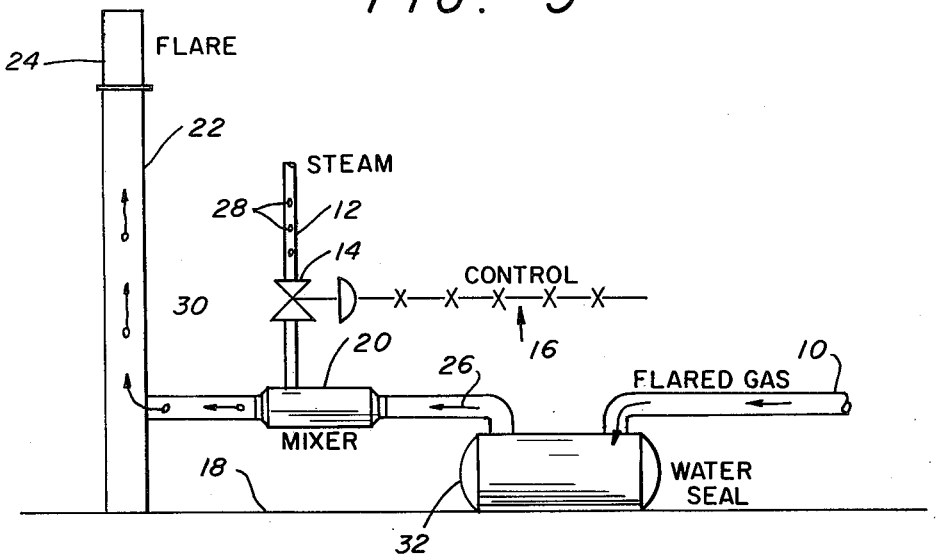
FIGS. 1 and 2 show alternate methods of using a vent gas-steam mixing chamber so as to supply to the flare stack a mixture of vent gases and water vapor, in which there is a substantial mol percentage of water vapor.
Figure 1:
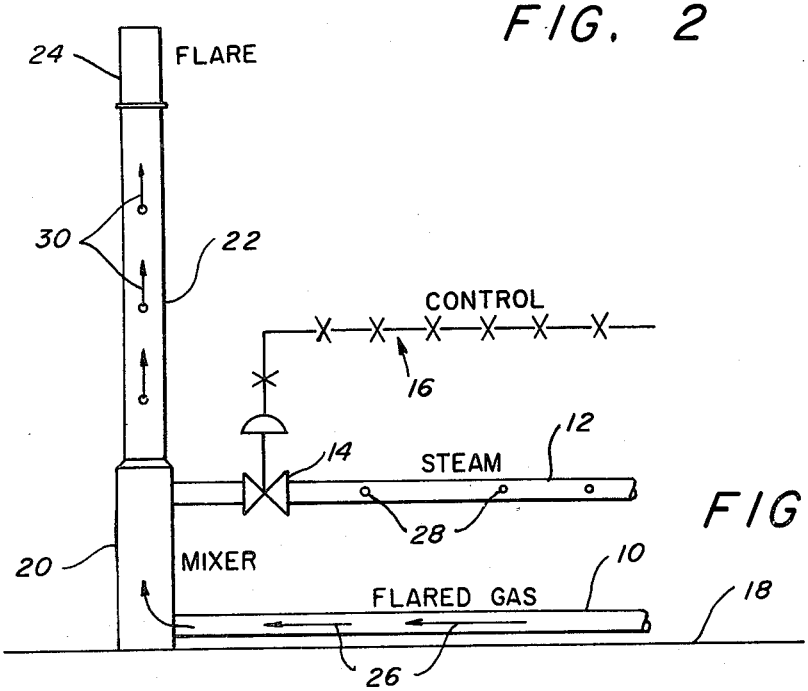

Referring now to the drawings and in particular to FIGS. 1 and 2, there are shown two schematic systems in which vented hydrocarbon gas is provided through a pipe 10 and flows in accordance with arrows 26 to a mixing chamber 20, where steam which is supplied through conduit 12 in accordance with indicia 28, passes through a control valve 14 and is mixed in the mixing chamber 20 with the gas 26, to provide a flow of hydrocarbons and water vapor in accordance with arrows 30 up the flare stack 22 to the flare 24 at the top. The principal difference between the two is that in FIG. 2 the flare gas is passed through a water seal 32 so as to prevent back flow of oxygen containing gases into the gas line 10. Also in FIG. 2 the mixer is horizontal, whereas in FIG. 1 it is vertical. Any type of control, indicated generally by the numeral 16, is possible and the specific control system forms no part of this invention. The invention lies principally in the design of the mixing chamber 20.

Figure 3:
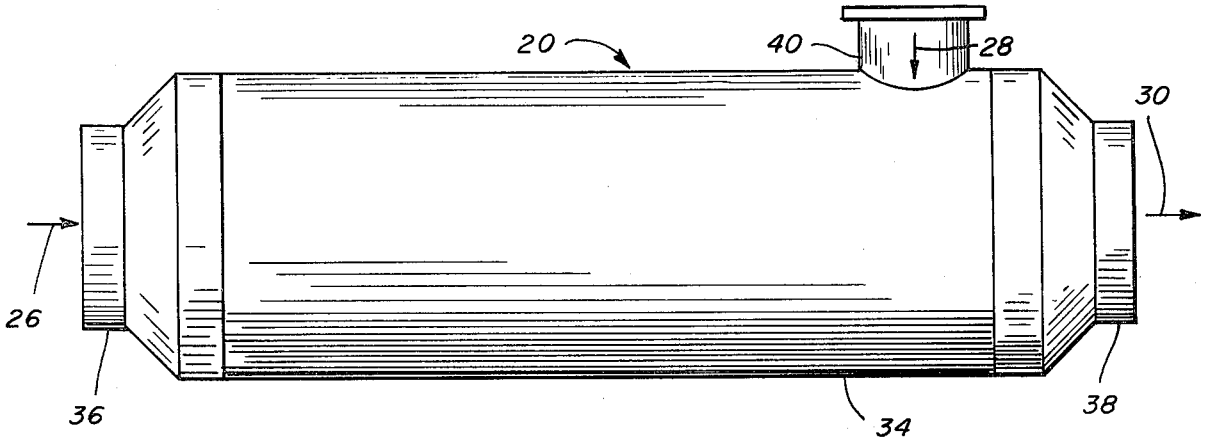
FIG. 3 shows an exterior view of one embodiment of this invention.

In FIG. 3 an external view of the mixing chamber 20 is shown. As indicated by the arrow 26, the vent gases, or hydrocarbons, flow through the pipe 36 into the chamber 20 whose outer housing is given the numeral 34 and flows out of the second end through a pipe 38, to the flare stack in accordance with arrow 30. Steam enters the mixing chamber 20 through a pipe 40 which passes through the side wall of the chamber and into the interior in accordance with arrow 28.

Figure 4:
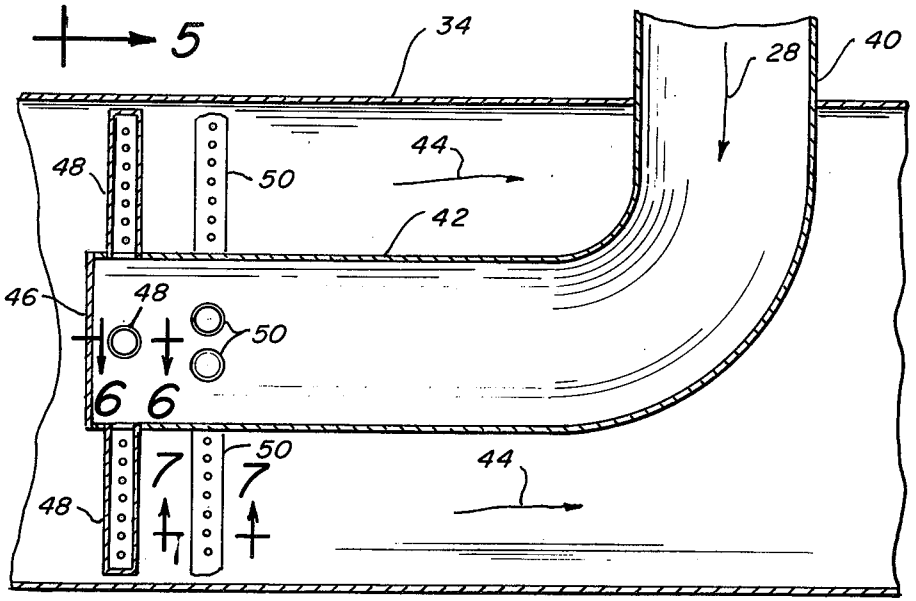
FIG. 4 shows a vertical cross section through the mixing chamber.
Figure 5:
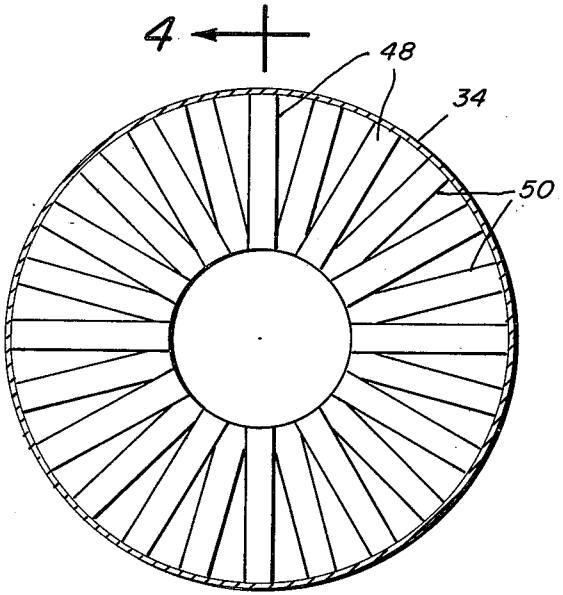
FIG. 5 shows a cross-sectional view of the mixing chamber taken along the plane 5—5 of FIG. 4.

FIG. 4 illustrates in cross section, the interior construction of the mixing chamber. It shows the cylindrical housing 34 which, as indicated in FIGS. 1 and 2, can be in a horizontal or a vertical position. The flow of gas is from the left to right in accordance with arrows 44. Steam flow 28 is through the conduit 40 entering through the side wall 34 and bent into a portion 42 which is coaxial with the housing 34 and headed upstream of the gas flow. The upstream end 46 of the conduit 42 is closed and steam exits through a plurality of radial arms or pipes 48, 50, which are positioned in at least one plane 48 or in a plurality of planes, including the arms 48, and the arms 50, or more. If there are more than one row of arms they would be shifted in azimuthal position so as to provide a tortuous path for the gas to flow so as to insure greater mixing of the vent gas and the steam issuing from the pipes. This radial position of the side arms or pipes 48 and 50 is shown in FIG. 5 which is a cross section of FIG. 4 taken along the plane 5—5.

Figure 7:
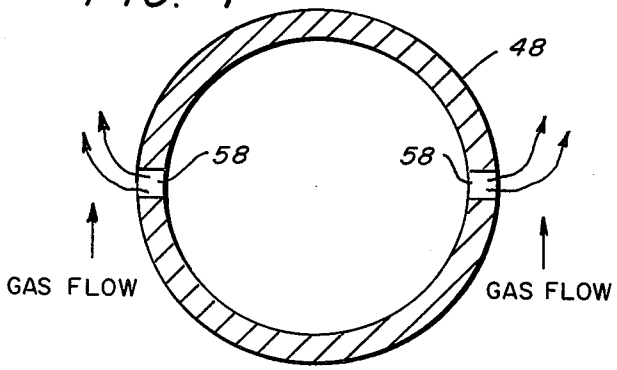
FIG. 7 is a view in cross section of one of the arms at the plane 7—7 of FIG. 4.
Figure 6:
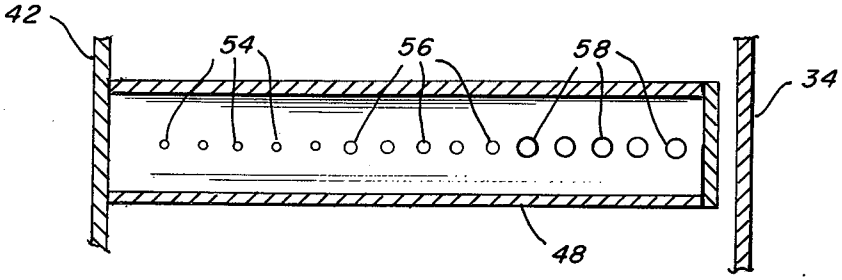
FIG. 6 is a cross-sectional view of one of the radial arms taken across the plane 6—6 of FIG. 4.

In FIG. 6 is shown in cross section one arm 48 of the plurality of arms 48 extending radially outward from the pipe 42. Since the area for passage of vent gas is greater at the outer radius of the arms the steam holes can be graded into a plurality of sizes such as 54, 56, 58, etc. As shown in FIG. 7, the steam openings 58, for example, are in a plane which is perpendicular to the flow of vent gas so that there is maximum contact mixing of the steam and the vent gas. In other words, there is essentially a plane of steam issuing from all of the vent holes in the radial arms, and the plane must be broken into by the transverse flow of the vent gases as they flow along the housing 34 from left to right.

It will be clear that the size and cross-sectional area of the housing is greater than that of the pipe 38, which carries the vent gases into the housing. The reason for this is that there must be a minimum of obstruction to the flow of gases and steam, since they are both substantially low pressure and there must be a minimum of impediment to their flow to the flare stack. The larger diameter compensates for this obstruction due to pressure of the pipe 42 and arms 48 and 50. Also, the flow of gases and steam, or gases and water vapor, must be as streamlined as possible, so as to minimize the pressure drop in flowing through the mixing chamber. Also, there must be sufficient mixture of steam with the vent gases so that the vent gases can be heated to a sufficiently high temperature for example, into the range of 150°F so that the gases will be able to carry a substantial mol percentage of water vapor with them, in order to make the smoke retarding effect substantial. Also, control means 16 (of conventional design) are provided so that the rate of flow of steam can be coordinated with the quantity of hydrocarbons being vented, so that adequate water vapor can be provided for the smoke prevention even with hydrocarbons of low hydrogen to carbon weight ratio.

Where the nature of the hydrocarbons permit, such as those with high hydrogen to carbon weight ratio, means are provided, though not shown, but well known in the art, for reduction or cut-off of the high pressure steam at the flare, for the purpose of smoke suppression. Conversely, where the hydrocarbons are of a low hydrogen to carbon weight ratio, and where there is great tendency to smoke in the combustion, means must be provided to utilize high pressure steam at the flame in the flare for smoke suppression to assist the smoke suppressing effect of the injection of low pressure steam into the hydrocarbon gas flow. For example, there can be complete suppression of smoke through steam hydrocarbon premixture with ethane ($H/C = 0.25$), and there will be residual smoking when steam and ethylene ($H/C = 0.166$) are premixed. In the latter case and if, without premixture of steam with hydrocarbons, the demand for high pressure steam should be 0.4 pounds of steam per pound of hydrocarbon, the high pressure demand would fall to from 0.25 to 0.3 pounds per pound where there is premixture of low pressure and less costly exhaust steam.

Further, there are means for furtherance of energy conservation through the use for smoke suppression of what would otherwise be spent or exhaust steam.

While the side arms for the steam injection into the mixing chamber are described as symmetrically arranged in one or more planes perpendicular to the steam conduit, they could, of course, be arranged in any other selected form which provided adequate mixing. Also, while the drilled holes in the radial arms are described as being in a transverse plane, they could be directed upstream or downstream or in angular directions. Although not shown, the steam could be injected from circular pipes along the inner surface of the housing, with the flow of steam directed in a transverse plane or upstream at a single or multiple angle.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed is:

1. Apparatus for using low pressure steam for smoke suppressing in flares for vented hydrocarbons, comprising:

a. a cylindrical housing including pipe means for inflow of vented hydrocarbons at a first end and outflow of vented hydrocarbons plus water vapor to the flare stack to be burned;

b. means for introducing low pressure steam into said housing through a plurality of nozzles in a substantially transverse direction to said hydrocarbon gas flow so as to provide turbulence and mixing with the hydrocarbon gas flow; and c. control means for controlling the rate of flow of low pressure steam in a selected relation to the rate of flow of hydrocarbons.

2. The apparatus as in claim 1 in which the diameter of said housing is greater than the diameter of the pipe for inflow of hydrocarbons.

3. The apparatus as in claim 1 including control means for controlling the rate of flow of low pressure steam in relation to the types of hydrocarbons being vented.

4. Apparatus for using low pressure steam for smoke suppressing in flares for vented hydrocarbons, comprising:

a. a cylindrical housing including means for inflow of vented hydrocarbons at a first end and outflow of vented hydrocarbons plus water vapor to the flare stack to be burned;

b. means for introducing low pressure steam comprising an axial conduit inside said housing and including a plurality of radial pipes extending through said conduit into the annular space between said conduit and said housing and a plurality of openings in the walls of each of said pipes; and c. control means for controlling the rate of flow of low pressure steam in a selected relation to the rage of flow of hydrocarbons.

5. The apparatus as in claim 4 in which said pipes are arranged in at least one transverse plane.

6. The apparatus as in claim 4 in which said plurality of openings in said pipes are in a plane transverse to the axis of said housing.

7. The apparatus as in claim 4 in which the sizes of said openings can be varied with radius along the pipes.

8. Apparatus for using low pressure steam for smoke suppressing in flares for vented hydrocarbons, comprising:

a. a cylindrical housing including means for inflow of vented hydrocarbons at a first end and outflow of vented hydrocarbons plus water vapor to the flare stack to be burned;

b. means for introducing low pressure steam comprising at least one circumferential conduit inside said housing and a plurality of orifices in said at least one conduit; and c. control means for controlling the rate of flow of low pressure steam in a selected relation to the rate of flow of hydrocarbons.

* * * * *